US006335597B1

(12) United States Patent
Ueno et al.

(10) Patent No.: US 6,335,597 B1
(45) Date of Patent: Jan. 1, 2002

(54) COLOR CATHODE-RAY TUBE APPARATUS

(75) Inventors: Hirofumi Ueno; Kazunori Satou; Tsutomu Takekawa, all of Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/592,434

(22) Filed: Jun. 12, 2000

(30) Foreign Application Priority Data

Jun. 16, 1999 (JP) ..... 11-169212

(51) Int. Cl.[7] ..... G09G 1/04

(52) U.S. Cl. ..... 315/364; 315/364; 315/368.11; 315/370; 315/382; 313/412; 313/413; 313/449

(58) Field of Search ..... 315/364, 368.11, 315/368.16, 368.27, 368.15, 368.21, 370, 379, 381, 382, 382.1, 383, 386, 395; 313/412, 413, 414, 449

(56) References Cited

U.S. PATENT DOCUMENTS 4,935,663 A * 6/1990 Shimoma et al. ..... 313/412
5,631,521 A * 5/1997 Hasegawa et al. ..... 313/414
5,694,004 A * 12/1997 Kimiya et al. ..... 315/15

FOREIGN PATENT DOCUMENTS

JP 64-38947 2/1989

* cited by examiner

*Primary Examiner*—Don Wong
*Assistant Examiner*—Tuyet Thi Vo
(74) *Attorney, Agent, or Firm*—Oblon, Spivak, McClelland, Maier & Neustadt, P.C.

(57) ABSTRACT

A color cathode-ray tube apparatus comprises an electron gun structure for generating three electron beams arranged in line, the three electron beams comprising a center beam and a pair of side beams. The electron gun structure forms a main lens for ultimately focusing the three electron beams on a phosphor screen. The main lens is formed by a focus electrode, an additional electrode and an anode electrode which are arranged in a direction of traveling of electron beams. A voltage application unit applies a voltage to each of the electrodes such that a voltage higher than a voltage applied to the focus electrode and lower than a voltage applied to the anode electrode is applied to the additional electrode, and in synchronism with deflection of the three electron beams by the deflection yoke, a value S varies: S=[(applied voltage to the additional electrode)−(applied voltage to the focus electrode)]/[(applied voltage to the anode electrode)−(applied voltage to the focus electrode)]. An angle of emission of each of the side beams emanating from the main lens varies in synchronism with a variation of the value S.

6 Claims, 7 Drawing Sheets

COLOR CATHODE-RAY TUBE APPARATUS

CROSS-REFERENCE TO RELATED APPLICATIONS

This application is based upon and claims the benefit of priority from the prior Japanese Patent Application No. 11-169212, filed Jun. 16, 1999, the entire contents of which are incorporated herein by reference.

BACKGROUND OF THE INVENTION

The present invention relates to a color cathode-ray tube (CRT) apparatus, and more particularly to a color CRT apparatus capable of displaying a high-quality image, with reduction in oval deformation of a beam spot on a peripheral portion of a screen.

Self-convergence in-line type color CRT apparatuses, each having an electron gun structure with a BPF (Bi-Potential Focus) type DAC&F (Dynamic Astigmatism Correction and Focus) system, have now been widely used.

The electron gun structure with the BPF type DAC&F system, as shown in FIG. 11, comprises three cathodes K arranged in line; a first grid G1; a second grid G2; a third grid G3 having two segments G31 and G32; and a fourth grid G4. The grids G1 to G4 are disposed in the named order from the cathodes (K) side toward a phosphor screen. Each grid has three in-line electron beam passage holes which are formed in association with the three cathodes K.

A voltage obtained by superimposing video signals upon a voltage of about 150V is applied to the cathodes K. The first grid G1 is grounded. A voltage of about 600V is applied to the second grid G2. A DC voltage of about 6 kV is applied to the first segment G31 of the third grid G3. A dynamic voltage obtained by superimposing a parabolic AC voltage component, which increases in accordance with an increase in the degree of deflection of an electron beam, upon a DC voltage of about 6 kV, is applied to the second segment G32 of the third grid G3. A voltage of about 26 kV is applied to the fourth grid G4.

An electron beam generating unit is constituted by the cathodes K, first grid G1 and second grid G2. The electron beam generating unit generates electron beams and forms an object point for a main lens. A prefocus lens is constituted by the second grid G2 and the first segment G31 and it prefocuses the electron beams generated from the electron beam generating unit. A BPF type main lens is constituted by the second segment G32 and the fourth grid G4. The BPF type main lens accelerates the prefocused electron beams toward the phosphor screen and ultimately focuses them on the phosphor screen.

Where electron beams are deflected onto a corner portion of the phosphor screen, a potential difference between the second segment G32 and the fourth grid G4 takes a minimum value and the intensity of the main lens formed therebetween lowers to a minimum. At the same time, a maximum potential difference is provided between the first segment G31 and the second segment G32, and a quadrupole lens is formed which has a focusing function in a horizontal direction and a divergence function in a vertical direction. At this time, the intensity of the quadrupole lens takes a maximum value.

Where the electron beams are deflected onto a corner portion on the phosphor screen, a distance between the electron gun structure and the phosphor screen becomes longest and an image point is formed at a farther position. In the case of the electron gun structure with the above-described BPF type DAC&F system, the formation of the image point at a farther position is compensated by decreasing the intensity of the main lens. In addition, a deflection aberration caused by a pin-cushion-shaped horizontal deflection magnetic field and a barrel-shaped vertical deflection magnetic field of a deflection yoke is compensated by the formation of a quadrupole lens.

In order to enhance the image quality in the color CRT apparatus, it is necessary to improve the focusing characteristics and beam spot shape on the phosphor screen. In the conventional in-line type color CRT apparatus, as shown in FIG. 12A, a beam spot 1 formed on a central area of the phosphor screen is circular but a beam spot 1 formed on a peripheral area extending from an end of a horizontal axis (X-axis) to an end of a diagonal axis (D-axis) is deformed in an oval shape along a horizontal axis (X-axis) ("horizontal deformation") due to deflection aberration and a blur 2 occurs along a vertical axis (Y-axis). The image quality is thus degraded.

In order to solve this problem, in the electron gun structure with the BPF type DAC&F system, the low-voltage-side grid constituting the main lens is composed of a plurality of segments, like the third grid G3, and a quadrupole lens which has a lens intensity varying dynamically in accordance with a deflection amount of the electron beam is formed between the segments. Accordingly, the blur 2 of the beam spot 1 is eliminated, as shown in FIG. 12B.

However, in the electron gun structure with the BPF type DAC&F system, too, horizontal deformation occurs in the beam spot 1 formed on the peripheral area extending from the end of the horizontal axis (X-axis) to the end of the diagonal axis (D-axis), as shown in FIG. 12B. The horizontal deformation of the beam spot 1 occurs because the three electron beams generated from the in-line type electron gun structure are deflected by a non-uniform magnetic field produced by the deflection yoke which comprises a pin-cushion-shaped horizontal deflection field and a barrel-shaped vertical deflection field.

It is possible, therefore, to prevent horizontal deformation of the beam spot 1 by substantially uniformizing the shapes of both the horizontal deflection field and vertical deflection field produced by the deflection yoke. If the shapes of the deflection fields are substantially uniformized, however, three electron beams 4B, 4G and 4R will converge in front of a phosphor screen, as shown in FIG. 13. As a result, as shown in FIG. 14, a convergence error occurs and rasters 6B, 6G and 6R described on the phosphor screen are displaced from one another. In FIG. 13, a line 8 indicates the electron gun structure, and a line 9 a deflection center position.

In order to correct the convergence error, a method is known wherein an electron lens 10 having a function of a bipolar lens, whose intensity varies in synchronism with a variation in deflection fields, as shown in FIGS. 15A and 15B, is formed in the electron gun structure. According to this method, the electron lens 10 deflects the locus of each of side beams 4B and 4R by an angle θ to the tube axis (Z-axis) so that they may converge on the phosphor screen 5. In this method, however, since the locus of each of the side beams 4B and 4R is deflected in front of the main lens 11, the side beams 4B and 4R do not pass through a central portion of the main lens 11. Consequently, the side beams 4B and 4R are affected by aberration of the main lens 11. As a result, a blur 2 occurs in the beam spot 1 on the phosphor screen 5, and the quality of the displayed image is degraded.

As has been described above, in order to enhance the image quality of the color CRT apparatus, the focusing characteristics and beam spot shape on the phosphor screen need to be improved.

With the conventional electron gun structure of the BPF type DAC&F system, a vertical blue of the beam spot due to deflection aberration is eliminated and the beams are focused over the entire area of the phosphor screen. However, in the case of the conventional electron gun structure of the BPF type DAC&F system, horizontal deformation of the beam spot formed on a peripheral area extending from an end of the horizontal axis to an end of the diagonal axis on the phosphor screen cannot be eliminated. Consequently, the horizontal deformation of the beam spot interferes with the electron beam passage holes in the shadow mask, thus causing moire, etc. and degrading the quality of display images such as characters.

BRIEF SUMMARY OF THE INVENTION

The present invention has been made in order to overcome the above problems, and the object of the invention is to provide a color cathode-ray tube capable of displaying a high-quality image, while reducing an oval deformation of a beam spot on a peripheral area of a screen.

According to the present invention, in order to achieve the above object, there is provided a color cathode-ray tube apparatus comprising:

an electron gun structure having an electron beam generating unit for generating three electron beams arranged in line, the three electron beams comprising a center beam and a pair of side beams, and a main lens for accelerating the three electron beams generated by the electron beam generating unit toward a phosphor screen and ultimately focusing the three electron beams on the phosphor screen; and a deflection yoke for generating deflection fields for deflecting the three electron beams generated from the electron gun structure, wherein the main lens is formed by a focus electrode and an anode electrode both arranged in a direction of traveling of electron beams, at least one additional electrode disposed between the focus electrode and the anode electrode, and voltage application means for applying a voltage to each of the electrodes such that a voltage higher than a voltage applied to the focus electrode and lower than a voltage applied to the anode electrode is applied to the additional electrode, and in synchronism with deflection of the three electron beams by the deflection yoke, a value S, defined below, varies, S=[(applied voltage to the additional electrode)−(applied voltage to the focus electrode)]/[(applied voltage to the anode electrode)−(applied voltage to the focus electrode)], and wherein an angle of emission of each of the side beams emanating from the main lens varies in synchronism with a variation of the value S.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of a color cathode-ray tube (CRT) apparatus according to the present invention will now be described with reference to the accompanying drawings.

Figure 15A:
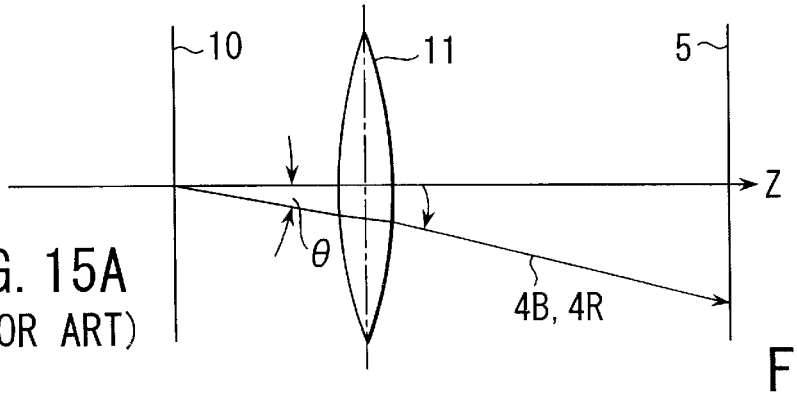
FIG. 15A (PRIOR ART)
FIGS. 15A and 15B are views for explaining a concept of varying the locus of each side beam in front of a main lens in a conventional electron gun structure.
Figure 15B:
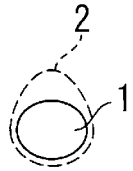
FIG. 15B (PRIOR ART)

As has been described above, where the shapes of deflection magnetic fields are made substantially uniform in order to reduce horizontal deformation of each beam spot on the phosphor screen in the conventional self-convergence in-line type color cathode-ray tube (CRT) apparatus, the three electron beams do not converge on the phosphor screen. The convergence error can be corrected by varying the loci of a pair of side beams. However, as shown in FIGS. 15A and 15B, if the loci of the side beams are varied in front of the main lens 11, they do not pass through the central portion of the main lens 11 and are affected by aberration of the main lens 11. This results in occurrence of a blur and degradation in image quality.

Figure 1A:
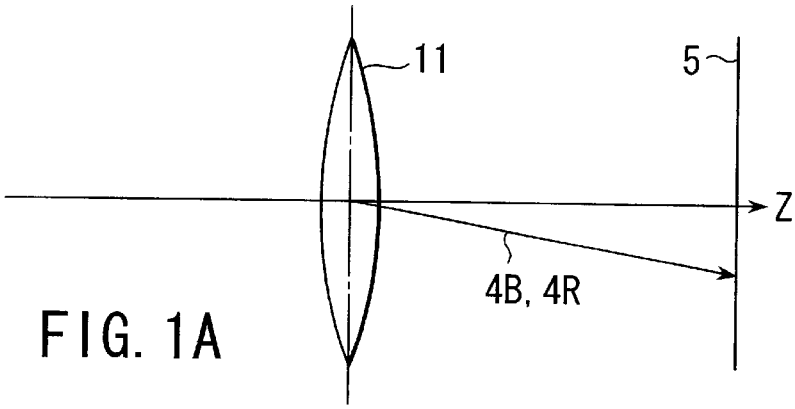
FIGS. 1A and 1B are views for describing the concept of the present invention.
Figure 1B:
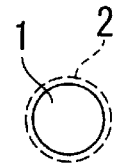

If the loci of the paired side beams 4B and 4R can be varied within the main lens 11, as shown in FIGS. 1A and 1B, the paired side beams 4B and 4R can pass through the central portion of the main lens 11 and are hardly susceptible to aberration of the main lens 11. Accordingly, a blur of the beam spot on the phosphor screen can be reduced. Even where the shapes of the deflection fields are substantially uniformized in order to reduce the horizontal deformation on the phosphor screen, the convergence error of the three electron beams on the phosphor screen can be compensated.

Therefore, on the phosphor screen, the horizontal deformation of each beam spot can be reduced by substantially uniformizing the shapes of deflection fields, the convergence error can be compensated by varying the loci of the paired side beams within the main lens 11, and the blur of each beam spot can be reduced by passing the side beams through the central portion of the main lens 11.

Means for varying the loci of a pair of side beams 4B and 4R within a main lens 11 will now be described.

Figure 2A:
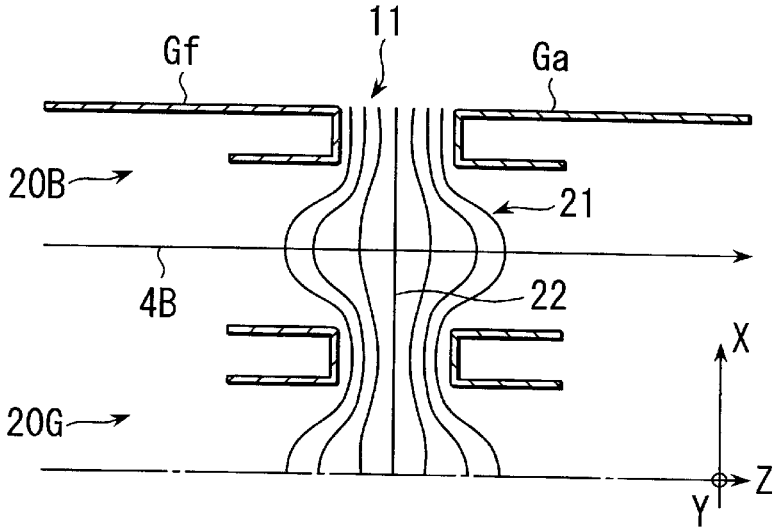
FIG. 2A is a view for describing how a rotation-symmetric bi-potential type main lens acts on side beams.

FIG. 2A is a horizontal cross-sectional view showing a part of a rotation-symmetric bi-potential type main lens produced in a general in-line type electron gun structure. A pair of side guns 20B and 20R (only 20B shown) have the same structure as a center gun 20G. As is indicated by an equipotential surface 21, the main lens of each side gun 20B (20R) is formed by an electric field which is symmetric between a focus electrode Gf and an anode electrode Ga with respect to a geometrical center of the main lens 11, that is, a planar equipotential surface 22 created at an equidistant point from the focus electrode Gf and anode electrode Ga. Accordingly, the locus of the side beam 4B (4R) is not varied by the electric field constituting the main lens 11. For example, if a voltage of 6 KV is applied to the focus electrode Gf and a voltage of 26 KV is applied to the anode electrode Ga, a potential at the equipotential surface 22 is 16 KV.

Figure 2B:
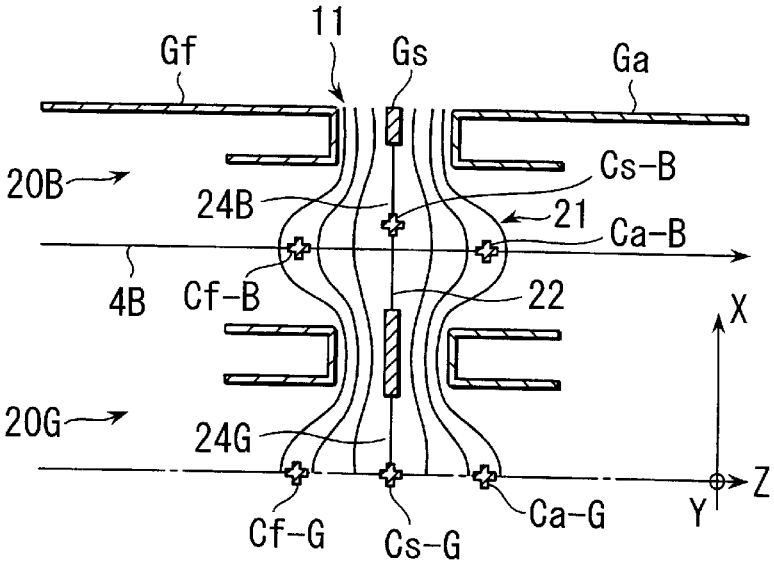
FIG. 2B is a view for describing how a rotation-symmetric bi-potential type main lens, which is formed when an additional electrode is disposed at a geometrical center of the main lens, acts on side beams.

FIG. 2B is a horizontal cross-sectional view showing a part of a main lens in a case where an additional electrode having side beam passage holes, which are off-center from side beam passage holes of the focus electrode and anode electrode, is disposed at a geometrical center of the main lens. Specifically, the plate-like additional electrode Gs is disposed at the geometrical center of the main lens 11. The additional electrode Gs has a circular center beam passage hole 24G for passage of a center beam (4G) and a pair of circular side beam passage holes 24B (24R) for passage of a pair of side beams 4B (4R).

The side beam passage hole 24B (24R) is formed such that its center Cs-B is off-center from a center Cf-B of the side beam passage hole of the focus electrode Gf opposed to the additional electrode Gs and a center Ca-B of the side beam passage hole of the anode electrode Ga opposed to the additional electrode Gs, toward the outside in the direction of arrangement of the electron beam passage holes, that is, away from the center beam. The center beam passage hole 24G is formed such that its center Cs-G is aligned with a center Cf-G of the center beam passage hole of the focus electrode Gf and a center Ca-G of the center beam passage hole of the anode electrode Ga. Specifically, a distance between the center Cs-G of the center beam passage hole 24G of the additional electrode Gs and the center Cs-B of the side beam passage hole 24B (24R) thereof is greater than each of a distance between the center Cf-G of the center beam passage hole of the focus electrode Gf and the center Cf-B of the side beam passage hole thereof and a distance between the center Ca-G of the center beam passage hole of the anode electrode Ga and the center Ca-B of the side beam passage hole thereof.

Figure 3A:
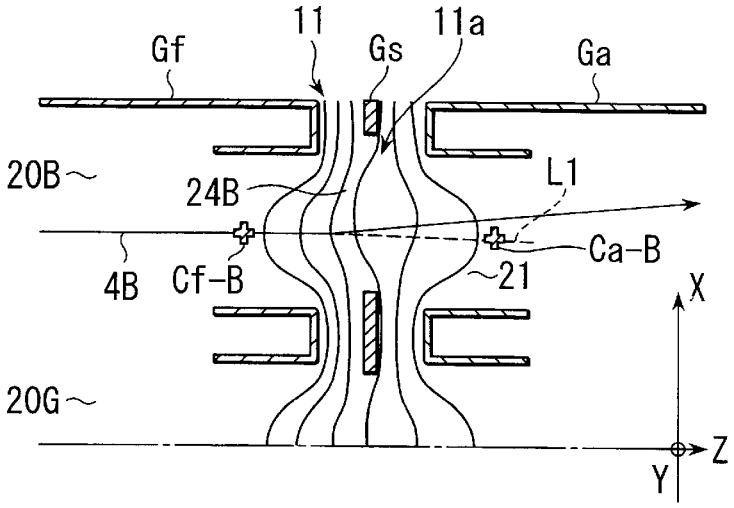
FIG. 3A is a view for describing how a main lens, which is formed when a potential lower than an equipotential surface at the geometrical center is applied to the additional electrode shown in FIG. 2B, acts on side beams.

In this case, the side beam 4B (4R) travels inside the side beam passage hole 24B (24R) of the additional electrode Gs, that is, near the center beam.

Where a voltage of 16 KV, which is equal to a potential at the equipotential surface 22 created at the geometrical center of the main lens 11, is applied to the additional electrode Gs disposed at the geometrical center of the main lens 11, the main lens 11 of each side gun 20B (20R) is formed by an electric field as shown in FIG. 2B. This electric field is symmetric, as indicated by the equipotential surface 21, between the focus electrode Gf and the anode electrode Ga with respect to the planar equipotential surface 22 created at the geometrical center of the main lens 11. In addition, the main lens 11 is rotation-symmetric with respect to a straight line connecting the center Cf-B of the side beam passage hole of the focus electrode Gf and the center Ca-B of the side beam passage hole of the anode electrode Ga. Accordingly, the main lens 11 is formed by a similar electric field as in the case where the additional electrode Gs is not disposed, as shown in FIG. 2A. Thus, the locus of the side beam 4B (4R) is not varied by the electric field which forms the main lens 11.

Where a potential lower than 16 KV is applied to the additional electrode Gs, the main lens 11 of each side gun 20B (20R) is formed by an electric field as shown in FIG. 3A. Specifically, as indicated by the equipotential surface 21, the potential on the anode electrode (Ga) side permeates into the focus electrode (Gf) side through the side beam passage hole 24B (24R) of the additional electrode Gs. The center of the side beam passage hole 24B (24R), as mentioned above, is off-center from the centers of the side beam passage holes of the focus electrode Gf and anode electrode Ga toward the outside in the direction of arrangement of the electron beam passage holes. Accordingly, an aperture lens 11*a*, which is non-rotational-symmetric with respect to a straight line L1 connecting the center Cf-B of the side beam passage hole of the focus electrode Gf and the center Ca-B of the side beam passage hole of the anode electrode Ga, is formed within the main lens 11. The center axis of the aperture lens 11*a* is outwardly eccentric to the straight line L1.

Figure 3B:
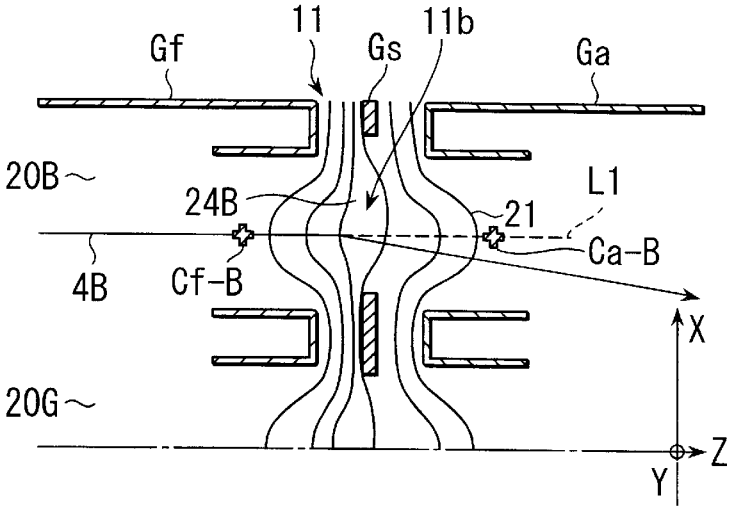
FIG. 3B is a view for describing how a main lens, which is formed when a potential higher than an equipotential surface at the geometrical center is applied to the additional electrode shown in FIG. 2B, acts on side beams.

Thus, the locus of the side beam 4B (4R) traveling through the main lens 11 is deviated away from the center beam by means of the aperture lens 11*a* formed within the main lens 11.

Where a potential higher than 16 KV is applied to the additional electrode Gs, the main lens 11 of each side gun 20B (20R) is formed by an electric field as shown in FIG. 3B. Specifically, as indicated by the equipotential surface 21, the potential on the focus electrode (Gf) side permeates into the anode electrode (Ga) side through the side beam passage hole 24B (24R) of the additional electrode Gs. In this case, an aperture lens 11*b,* which is non-rotational-symmetric with respect to the axis of the main lens 11, that is, the straight line L1 connecting the center Cf-B of the side beam passage hole of the focus electrode Gf and the center Ca-B of the side beam passage hole of the anode electrode Ga, is formed within the main lens 11. The center axis of the aperture lens 11*b* is outwardly eccentric to the straight line L1.

Thus, the locus of the side beam 4B (4R) traveling through the main lens 11 is deviated toward the center beam by means of the aperture lens 11*b* formed within the main lens 11.

More specifically, the plate-like additional electrode Gs is disposed at the geometrical center between the focus electrode Gf and the anode electrode Ga which constitute the main lens 11. The additional electrode Gs has the side beam passage hole, the center of which is off the centers of the side beam passage holes of the focus electrode Gf and anode electrode Ga. A potential different from the potential at the geometrical center of the main lens 11 is applied to the additional electrode Gs. Thereby, the aperture lens which is non-rotation-symmetric with respect to the axis of the main lens is formed within the main lens 11. The intensity of the aperture lens increases in accordance with an increase in potential difference between the potential at the geometrical center and the potential applied to the additional electrode Gs.

Thus, by varying this potential difference, the intensity of the aperture lens can be freely varied. Accordingly, the locus of the side beam can be freely varied within the main lens 11 and the angle of the side beam emanating from the main lens 11 can be varied.

In the above description, the aperture lens is formed by varying the voltage applied to the additional electrode. Alternatively, the same effect can be obtained by varying a value:

S=[(applied voltage to the additional electrode)−(applied voltage to the focus electrode)]/[(applied voltage to the anode electrode)−(applied voltage to the focus electrode)].

Embodiments of a color CRT apparatus equipped with the above-described electron gun structure will now be described.

[Embodiment 1]

Figure 4:
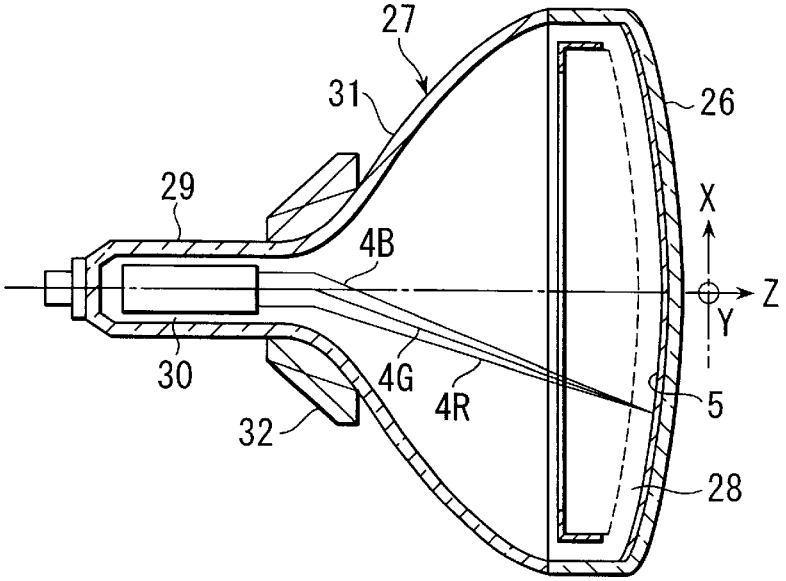
FIG. 4 is a horizontal cross-sectional view schematically showing the structure of a color CRT apparatus according to the present invention.

As is shown in FIG. 4, an in-line type color CRT apparatus has an envelope comprising a panel 26, a neck 29 and a funnel 27. The panel 26 has, on its inner surface, a phosphor screen 5 composed of a three-color phosphor layer which emits blue, green and red. A shadow mask 28, which has a great number of electron beam passage holes on its inside, is disposed to be opposed to the phosphor screen 5. The neck 29 includes an in-line type electron gun structure 30. The electron gun structure 30 emits three in-line electron beams 4B, 4G and 4R, that is, a center beam 4G and a pair of side beams 4B and 4R, which travel in the same horizontal plane. A deflection yoke 32 is mounted on a region extending from a large-diameter portion 31 of the funnel 27 to the neck 29. The deflection yoke 32 generates deflection magnetic fields for deflecting the three electron beams 4B, 4G and 4R emitted from the electron gun structure 30 in a horizontal direction (X) and a vertical direction (Y). The horizontal deflection magnetic field and vertical deflection magnetic field generated by the deflection yoke 32 are substantially uniform and are less non-uniform than the pin-cushion-shaped horizontal deflection field and barrel-shaped vertical deflection field of the conventional self-convergence in-line type color CRT apparatus.

The three electron beams 4B, 4G and 4R emitted from the electron gun structure 30 are deflected by the deflection fields generated by the deflection yoke 32 and horizontally and vertically scanned over the phosphor screen 5 via the shadow mask 28. Thereby, color images are displayed.

Figure 5:
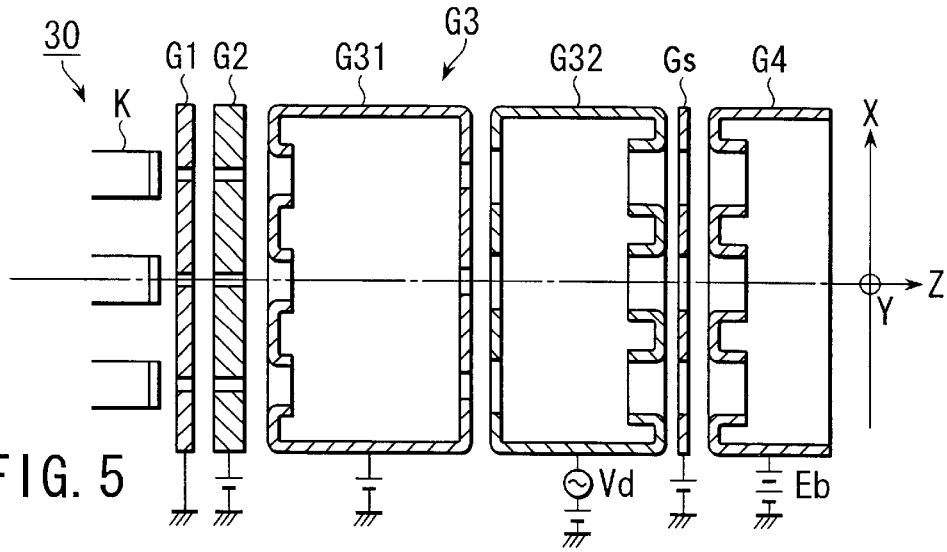
FIG. 5 is a horizontal cross-sectional view schematically showing the structure of an electron gun structure applied to the color CRT apparatus shown in FIG. 4.

As is shown in FIG. 5, the electron gun structure 30 comprises three cathodes K arranged in line in the horizontal direction (X); three heaters (not shown) for individually heating the cathodes K; and six electrodes. The six electrodes are a first grid G1; a second grid G2; a third grid G3 having a first segment G31 and a second segment G32; an additional electrode Gs; and a fourth grid G4. The six electrodes G1, G2, G31, G32, Gs and G4 are disposed in the named order from the cathodes (K) side toward the phosphor screen. The heaters, cathodes K and six electrodes are integrally fixed by a pair of insulating support members (not shown).

The first and second grids G1 and G2 are composed of integral plate-like electrodes, respectively. These plate-like electrodes have three in-line circular electron beam passage holes formed in the horizontal direction (X-direction) in association with the three cathodes K. The first segment G31 is composed of an integral cylindrical electrode. This cylindrical electrode has, in its end face opposed to the second grid G2, three in-line circular electron beam passage holes formed in the horizontal direction in association with the three cathodes K. In addition, this cylindrical electrode has, in its end face opposed to the second segment G32, three in-line non-circular electron beam passage holes formed in the horizontal direction in association with the three cathodes K. Each of these three non-circular electron beam passage holes is formed in an oval shape with its long axis set in, e.g. the vertical direction (Y-axis).

The second segment G32 is composed of an integral cylindrical electrode. This cylindrical electrode has, in its end face opposed to the first segment G31, three in-line non-circular electron beam passage holes formed in the horizontal direction in association with the three cathodes K. Each of these three non-circular electron beam passage holes is formed in an oval shape with its long axis set in, e.g. the horizontal direction (X-axis). In addition, this cylindrical electrode has, in its end face opposed to the additional electrode Gs, three in-line circular electron beam passage holes formed in the horizontal direction in association with the three cathodes K. The fourth grid G4 is composed of an integral cup-shaped electrode. The cup-shaped electrode has, in its end face opposed to the additional electrode Gs, three in-line circular electron beam passage holes formed in the horizontal direction in association with the three cathodes K.

Figure 6:
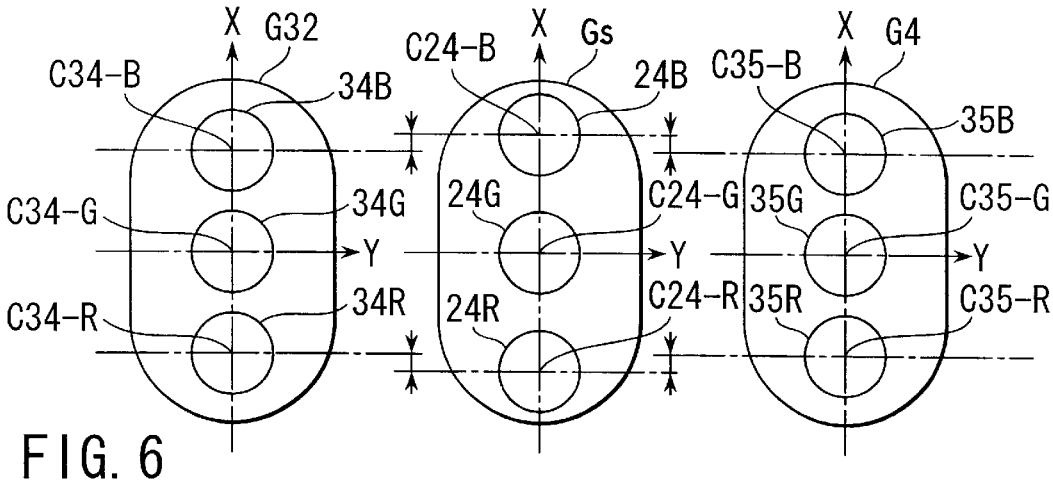
FIG. 6 shows arrangement of electron beam passage holes formed in a forth grid-side end face of a second segment, a plate face of an additional electrode, and a second segment-side end face of a fourth grid, which constitute a main lens according to an Embodiment 1 of the invention.

The additional electrode Gs is composed of an integral plate-shaped electrode. The additional electrode Gs is disposed at a geometrical center between the second segment G32 and the fourth grid G4. The additional electrode Gs, as shown in FIG. 6, has three in-line circular electron beam passage holes 24 (B, G, R) formed in the horizontal direction in association with the three cathodes K.

A center C24-G of the center beam passage hole 24G in the additional electrode Gs is aligned with a center C34-G of the center beam passage hole 34G in the second segment G32 and a center C35-G of the center beam passage hole 35G in the fourth grid G4. The center C24-G is located on a straight line connecting the center C34-G and center C35-G.

A center C24-B of the side beam passage hole 24B in the additional electrode Gs is deviated outward with respect to the horizontal direction (X) from a center C34-B of the side beam passage hole 34B in the second segment G32 and a center C35-B of the side beam passage hole 35B in the fourth grid G4. Specifically, the center C24-B is deviated away from the center beam passage hole 24G with respect to a straight line connecting the center C34-B and center C35-B. Accordingly, a distance between the center C24-B of the side beam passage hole 24B in the additional electrode Gs and the center C24-G of the center beam passage hole 24G is greater than a distance between the center C34-B of the side beam passage hole 34B in the second segment G32 and the center C34-G of the center beam passage hole 34G and also greater than a distance between the center C35-B of the side beam passage hole 35B in the fourth grid G4 and the center C35-G of the center beam passage hole 35G. In this case, the distance between the center C34-B of the side beam passage hole 34B in the second segment G32 and the center C34-G of the center beam passage hole 34G is substantially equal to the distance between the center C35-B of the side beam passage hole 35B in the fourth grid G4 and the center C35-G of the center beam passage hole 35G.

Similarly, a center C24-R of the side beam passage hole 24R in the additional electrode Gs is deviated outward with respect to the horizontal direction (X) from a center C34-R of the side beam passage hole 34R in the second segment G32 and a center C35-R of the side beam passage hole 35R in the fourth grid G4. Specifically, the center C24-R is deviated away from the center beam passage hole 24G with respect to a straight line connecting the center C34-R and center C35-R. Accordingly, a distance between the center C24-R of the side beam passage hole 24R in the additional electrode Gs and the center C24-G of the center beam passage hole 24G is greater than a distance between the center C34-R of the side beam passage hole 34R in the second segment G32 and the center C34-G of the center beam passage hole 34G and also greater than a distance between the center C35-R of the side beam passage hole 35R in the fourth grid G4 and the center C35-G of the center beam passage hole 35G. In this case, the distance between the center C34-R of the side beam passage hole 34R in the second segment G32 and the center C34-G of the center beam passage hole 34G is substantially equal to the distance between the center C35-R of the side beam passage hole 35R in the fourth grid G4 and the center C35-G of the center beam passage hole 35G.

Figure 7:
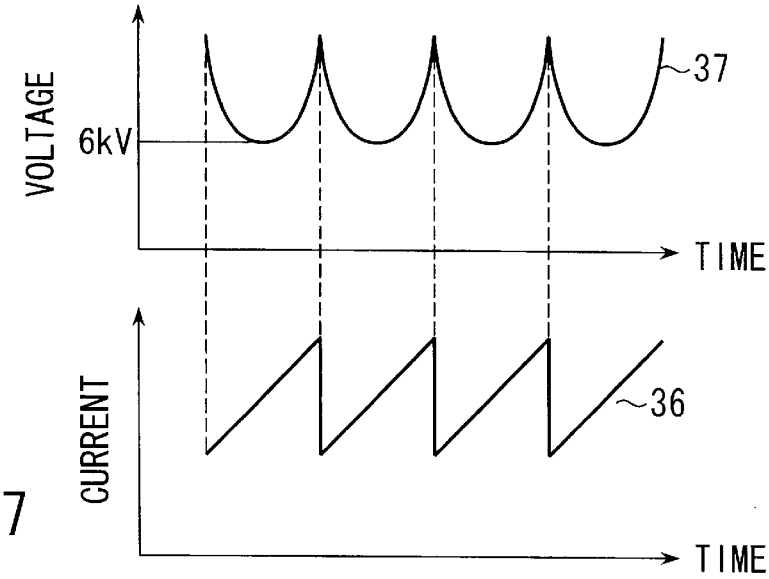
FIG. 7 is a graph showing a relationship between a dynamic voltage applied to the second segment of the electron gun structure shown in FIG. 5 and a deflection current.

In the electron gun structure 30 having the above structure, a voltage obtained by superimposing video signals upon a DC voltage of 150V is applied to the cathodes K. The first grid G1 is grounded. A DC voltage of about 600V is applied to the second grid G2. A DC voltage of about 6 kV is applied to the first segment G31 of the third grid G3. A dynamic voltage 37, which is obtained by superimposing a parabolically variable AC voltage component Vd upon a DC voltage of about 6 kV, as shown in FIG. 7, is applied to the second segment G32 of the third grid G3. The AC voltage component Vd is synchronized with a sawtooth deflection current 36 and increases in a parabolic fashion in accordance with an increase in the degree of deflection of the electron beam. Specifically, where the electron beam is focused on a central area of the phosphor screen, the dynamic voltage 37 takes a minimum value of about 6 kV. Where the electron beam is deflected to a corner area of the phosphor screen, the dynamic voltage 37 takes a maximum value. An anode voltage Eb of about 26 kV is applied to the fourth grid G4. A DC voltage of about 16 kV is applied to the additional electrode Gs. The voltage to be applied to the additional electrode Gs may be obtained by dividing the anode voltage Eb applied to the fourth grid G4 by means of a voltage-dividing resistor disposed along the electron gun structure 30.

With the application of the voltages to the respective grids, the electron gun structure 30 forms an electron beam generating unit, a prefocus lens and a main lens. The electron beam generating unit is constituted by the cathodes K, first grid G1 and second grid G2. The electron beam generating unit generates electron beams and forms an object point for a main lens. The prefocus lens is constituted by the second grid G2 and the first segment G31 and it prefocuses the electron beams generated from the electron beam generating unit. The main lens is constituted by the second segment G32 (focus electrode), the additional electrode Gs and the fourth grid G4 (anode electrode). The main lens accelerates the prefocused electron beams toward the phosphor screen and ultimately focuses them on the phosphor screen. At the time of deflection, the voltage applied to the second segment G32 increases, and a quadrupole lens is formed by a potential difference between the first segment G31 and second segment G32. The quadrupole lens focuses the electron beam in the horizontal direction (X) and diverges it in the vertical direction (V).

In the electron gun structure 30, at the time of non-deflection when the electron beam is focused on the central area of the phosphor screen, the main lens is formed by the second segment G32 to which the voltage of 6 kV is applied, the additional electrode Gs to which the voltage of 16 kV is applied, and the fourth grid G4 to which the voltage of 26 kV is applied. At this time, the main lens 11 is formed to be rotation-symmetric, as shown in FIG. 2B, and thus the locus of the side beam 4B (4R) is not varied by the electric field forming the main lens 11. Accordingly, the three electron beams are converged on the central area of the phosphor screen by inclining in advance the side beams to the center beam by means of an electron lens or a static field in front of the main lens and controlling the side beams so as to pass through the center of the main lens.

Figure 8:
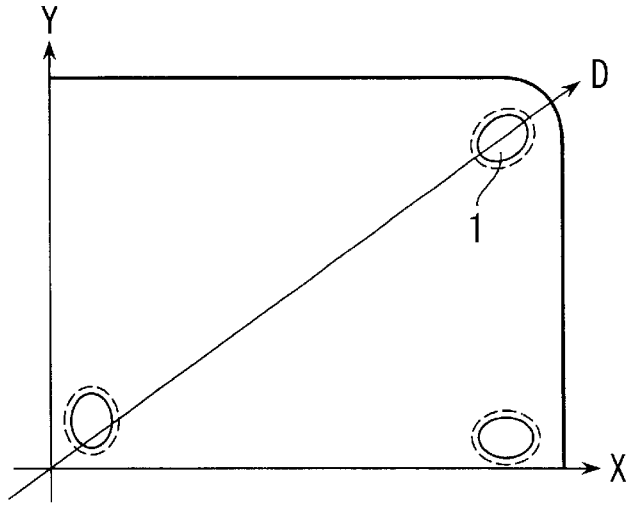
FIG. 8 shows a beam spot shape on a phosphor screen in the color CRT apparatus of the present invention.

At the time of deflection when the electron beam is deflected onto a peripheral area of the phosphor screen, the electron beam is deflected by the horizontal deflection magnetic field and vertical deflection magnetic field generated by the deflection yoke. Since the horizontal deflection magnetic field and vertical deflection magnetic field both are substantially uniform fields, horizontal deformation of the beam spot 1 on the peripheral area of the phosphor screen can be suppressed and the beam spot 1 can be made substantially circular, as shown in FIG. 8.

In addition, at the time of deflection, the voltage applied to the second segment G32 forming the main lens rises in accordance with an increase in the degree of deflection of the electron beam. Thus, in accordance with the increase in the degree of deflection of the electron beam, a potential difference between the first segment G31 and second segment G32 increases and the quadrupole lens is formed. Astigmatism due to the deflection fields is compensated by the quadrupole lens.

In addition, in accordance with the increase in the voltage applied to the second segment G32, a potential difference between the second segment G32 and fourth grid G4 decreases and the intensity of the main lens weakens. Accordingly, this compensates an over-focus occurring when the distance, over which the electron beams travel from the main lens to the phosphor screen, is increased due to the deflection.

Furthermore, in accordance with the variation in the voltage applied to the second segment G32, the following value S varies:

S=[(applied voltage to the additional electrode)−(applied voltage to the focus electrode)]/[(applied voltage to the anode electrode)−(applied voltage to the focus electrode)], that is, S=[(applied voltage to additional electrode Gs)−(applied voltage to second segment G32)]/[(applied voltage to fourth grid G4)−(applied voltage to second segment G32)].

Specifically, as in this Embodiment 1, where the applied voltage to the second segment G32 increases, the value S decreases. Since the potential difference between the second segment G32 and additional electrode Gs becomes less than the potential difference between the fourth grid G4 and additional electrode Gs, the potential on the fourth grid (G4) side permeates toward the second segment G32 and an aperture lens 11*a* equivalent to that shown in FIG. 3A is formed in the main lens 11. On the other hand, where the potential difference between the second segment G32 and additional electrode Gs becomes greater than the potential difference between the fourth grid G4 and additional electrode Gs, the potential on the second segment G32 side permeates toward the fourth grid G4 and an aperture lens 11*b* equivalent to that shown in FIG. 3B is formed in the main lens 11.

Figure 14:
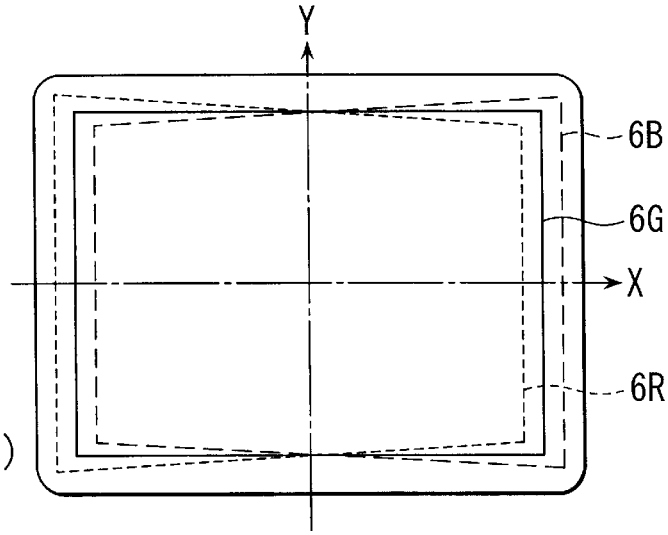
FIG. 14 (PRIOR ART)
FIG. 14 is a view for explaining a convergence error of three electron beams where deflection fields are made substantially uniform.

Accordingly, at the time of deflection, the loci of the paired side beams 4B and 4R are varied. Even where the horizontal deflection field and vertical deflection field are made substantially uniform, a convergence error as illustrated in FIG. 14 is compensated.

[Embodiment 2]

In Embodiment 2, the basic constitution of the electron gun structure is the same as that in Embodiment 1 shown in FIG. 5. A detailed description thereof, therefore, is omitted.

Figure 9:
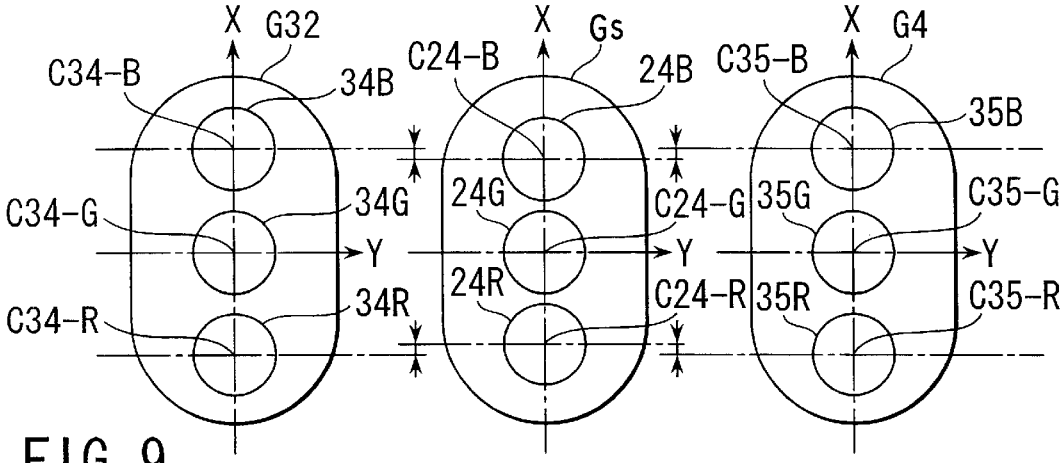
FIG. 9 shows arrangement of electron beam passage holes formed in a forth grid-side end face of a second segment, a plate face of an additional electrode, and a second segment-side end face of a fourth grid, which constitute a main lens according to an Embodiment 2 of the invention.

In the electron gun structure according to Embodiment 2, the additional electrode Gs, which is disposed at a geometrical center between the second segment G32 and the fourth grid G4, has three in-line circular electron beam passage holes formed in the horizontal direction in association with the three cathodes K, as shown in FIG. 9.

A center C24-G of the center beam passage hole 24G in the additional electrode Gs is aligned, like Embodiment 1, with a center C34-G of the center beam passage hole 34G in the second segment G32 and a center C35-G of the center beam passage hole 35G in the fourth grid G4.

A center C24-B of the side beam passage hole 24B in the additional electrode Gs is deviated inward with respect to the horizontal direction (X) from a center C34-B of the side beam passage hole 34B in the second segment G32 and a center C35-B of the side beam passage hole 35B in the fourth grid G4. Accordingly, a distance between the center C24-B of the side beam passage hole 24B in the additional electrode Gs and the center C24-G of the center beam passage hole 24G is less than a distance between the center C34-B of the side beam passage hole 34B in the second segment G32 and the center C34-G of the center beam passage hole 34G and also less than a distance between the center C35-B of the side beam passage hole 35B in the fourth grid G4 and the center C35-G of the center beam passage hole 35G. In this case, the distance between the center C34-B of the side beam passage hole 34B in the second segment G32 and the center C34-G of the center beam passage hole 34G is substantially equal to the distance between the center C35-B of the side beam passage hole 35B in the fourth grid G4 and the center C35-G of the center beam passage hole 35G.

Similarly, a center C24-R of the side beam passage hole 24R in the additional electrode Gs is deviated inward with respect to the horizontal direction (X) from a center C34-R of the side beam passage hole 34R in the second segment G32 and a center C35-R of the side beam passage hole 35R in the fourth grid G4. Accordingly, a distance between the center C24-R of the side beam passage hole 24R in the additional electrode Gs and the center C24-G of the center beam passage hole 24G is less than a distance between the center C34-R of the side beam passage hole 34R in the second segment G32 and the center C34-G of the center beam passage hole 34G and also less than a distance between the center C35-R of the side beam passage hole 35R in the fourth grid G4 and the center C35-G of the center beam passage hole 35G. In this case, the distance between the center C34-R of the side beam passage hole 34R in the second segment G32 and the center C34-G of the center beam passage hole 34G is substantially equal to the distance between the center C35-R of the side beam passage hole 35R in the fourth grid G4 and the center C35-G of the center beam passage hole 35G.

In the electron gun structure 30 with the above constitution, the same voltages as in Embodiment 1 are applied to the cathodes K and the electrodes except the additional electrode Gs.

Figure 10:
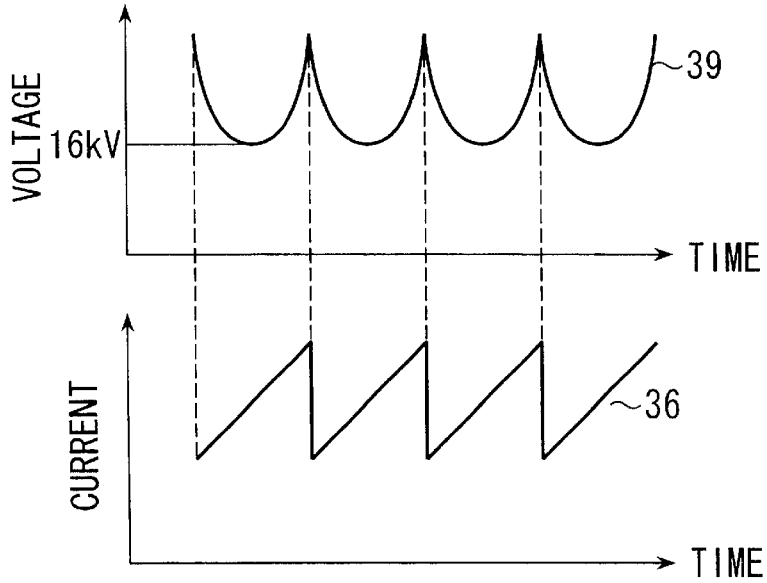
FIG. 10 is a graph showing a relationship between a variable voltage applied to the additional electrode shown in FIG. 9 and a deflection current.
Figure 11:
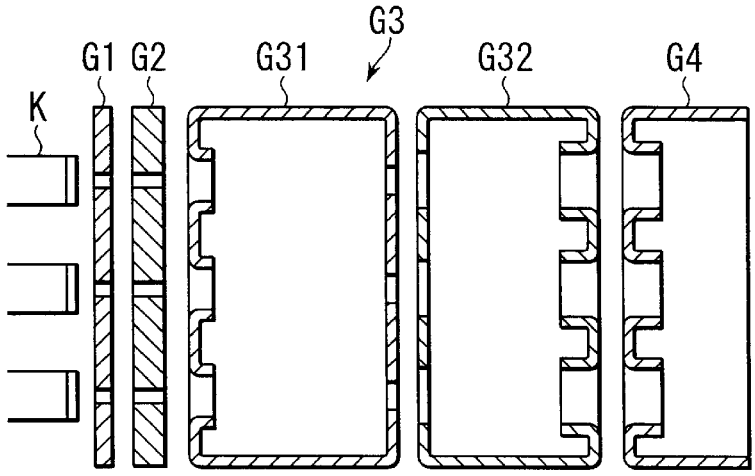
FIG. 11 (PRIOR ART)
FIG. 11 is a cross-sectional view showing the structure of a conventional electron gun structure with a BPF type DAC&F system.
Figure 12A:
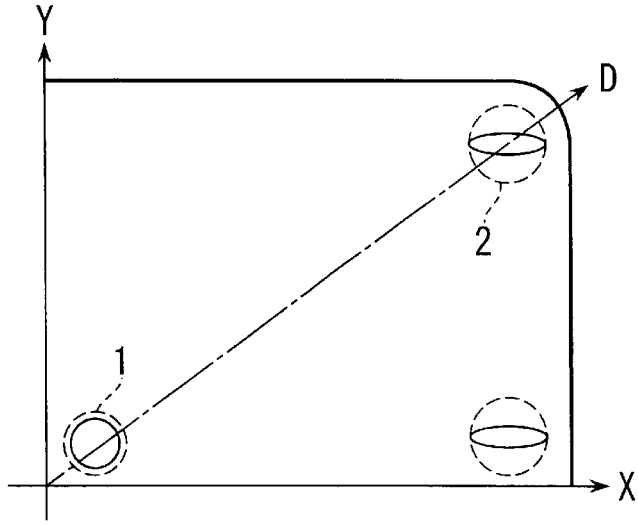
FIG. 12A (PRIOR ART)
FIG. 12A shows a beam spot shape on a phosphor screen of a conventional in-line type color CRT apparatus.
Figure 12B:
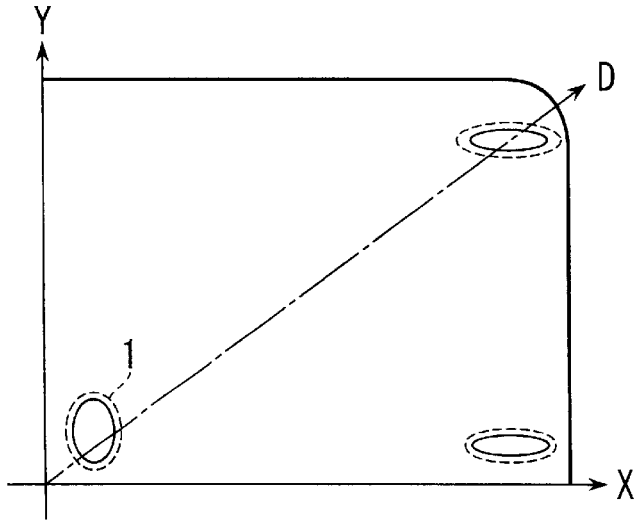
FIG. 12B (PRIOR ART)
FIG. 12B shows a beam spot shape on a phosphor screen of a color CRT apparatus having the electron gun structure with a BPF type DAC&F system as shown in FIG. 11.
Figure 13:
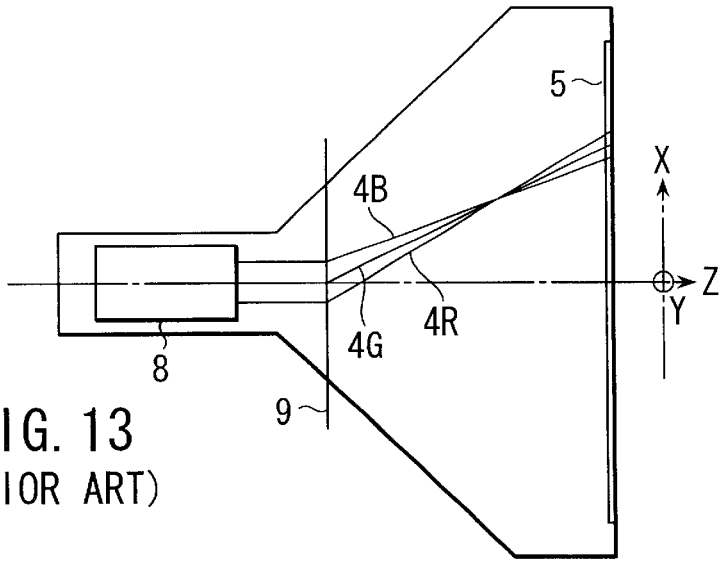
FIG. 13 (PRIOR ART)
FIG. 13 is a view for explaining convergence of three electron beams where deflection fields are made substantially uniform.

A dynamic voltage 39, which is obtained by superimposing a parabolically variable AC voltage component upon a DC voltage of about 16 kV, as shown in FIG. 10, is applied to the additional electrode Gs. The AC voltage component is synchronized with a sawtooth deflection current 36 and increases in a parabolic fashion in accordance with an increase in the degree of deflection of the electron beam. Specifically, where the electron beam is focused on a central area of the phosphor screen, the variable voltage 39 takes a minimum value of about 16 kV. Where the electron beam is deflected to a corner area of the phosphor screen, the variable voltage 39 takes a maximum value.

Specifically, in this electron gun structure, with the increase in the degree of deflection of the electron beam, the parabolically increasing dynamic voltage 37 as shown in FIG. 7 is applied to the second segment G32 of third grid G3 and, at the same time, the parabolically increasing variable voltage 39 as shown in FIG. 10 is applied to the additional electrode Gs.

In the electron gun structure 30, like Embodiment 1, at the time of non-deflection, the main lens is formed to be rotation-symmetric, as described with reference to FIG. 2B. Thus, the locus of the side beam 4B (4R) is not varied by the electric field forming the main lens 11. Accordingly, the three electron beams are converged on the central area of the phosphor screen by inclining in advance the side beams to the center beam by means of an electron lens or a static field in front of the main lens and controlling the side beams so as to pass through the center of the main lens.

At the time of deflection, the electron beam is deflected by the horizontal deflection magnetic field and vertical deflection magnetic field generated by the deflection yoke. Since the horizontal deflection magnetic field and vertical deflection magnetic field both are substantially uniform fields, horizontal deformation of the beam spot 1 on the peripheral area of the phosphor screen can be suppressed and the beam spot 1 can be made substantially circular, as shown in FIG. 8.

In addition, at the time of deflection, the voltage applied to the second segment G32 forming the main lens rises in accordance with an increase in the degree of deflection of the electron beam. Thus, in accordance with the increase in the degree of deflection of the electron beam, a potential difference between the first segment G31 and second segment G32 increases and the quadrupole lens is formed. Astigmatism due to the deflection fields is compensated by the quadrupole lens.

In addition, in accordance with the increase in the voltage applied to the second segment G32, a potential difference between the second segment G32 and fourth grid G4 decreases and the intensity of the main lens weakens. Accordingly, this compensates an over-focus occurring when the distance, over which the electron beams travel from the main lens to the phosphor screen, is increased due to the deflection.

Furthermore, in accordance with the variation in the voltage applied to the second segment G32, the following value S varies:

S=[(applied voltage to the additional electrode)−(applied voltage to the focus electrode)]/[(applied voltage to the anode electrode)−(applied voltage to the focus electrode)], that is, S=[(applied voltage to additional electrode Gs)−(applied voltage to second segment G32)]/[(applied voltage to fourth grid G4)−(applied voltage to second segment G32)].

Figure 16A:
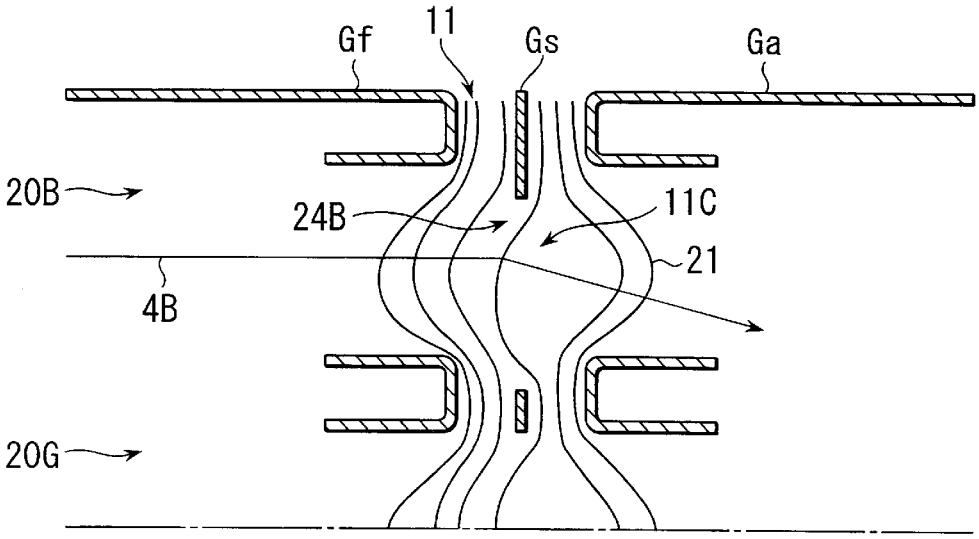
FIGS. 16A and 16B are views for describing how a main lens, which is formed when an additional electrode is disposed at a geometrical center of the main lens, acts on side beams, FIG. 16A showing a case where a potential lower than an equipotential surface at the geometrical center is applied to the additional electrode, and FIG. 3B showing a case where a potential higher than an equipotential surface at the geometrical center is applied to the additional electrode.
Figure 16B:
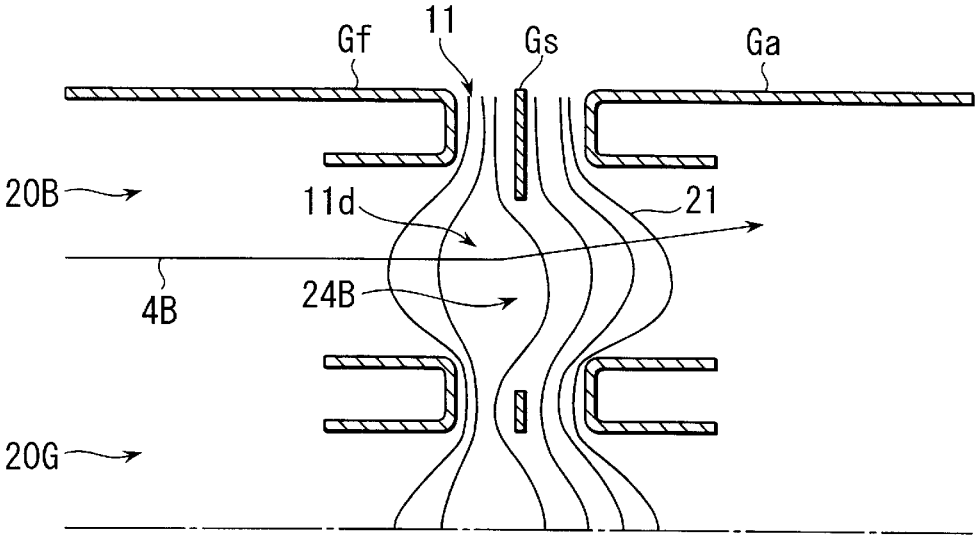

Specifically, as in this Embodiment 2, where the applied voltage to the second segment G32 increases and also the applied voltage to the additional electrode Gs increases, the value S increases. Since the potential difference between the second segment G32 and additional electrode Gs becomes greater than the potential difference between the fourth grid G4 and additional electrode Gs, the potential on the second segment G32 side permeates toward the fourth grid G4. Thereby, an aperture lens 11*d* for varying the loci of side beams, as shown in FIG. 16B, is formed in the main lens 11. On the other hand, where the potential difference between the second segment G32 and additional electrode Gs becomes less than the potential difference between the fourth grid G4 and additional electrode Gs, the potential on the fourth grid (G4) side permeates toward the second segment G32 and an aperture lens 11*c* for varying the loci of side beams, as shown in FIG. 16A, is formed in the main lens 11.

Accordingly, at the time of deflection, the loci of the paired side beams 4B and 4R are varied. Even where the horizontal deflection field and vertical deflection field are made substantially uniform, a convergence error as illustrated in FIG. 14 is compensated.

As has been described above, according to the color CRT apparatus of the present invention, at the time of deflection, the electron beams are deflected by the substantially uniform horizontal deflection field and vertical deflection field. Thus, the horizontal deformation of the beam spot 1 on the peripheral area of the phosphor screen can be prevented. In addition, at the time of deflection, the quadrupole lens, whose intensity dynamically varies in accordance with the degree of deflection of the electron beam, is formed. Thus, astigmatism due to the deflection fields can be compensated by the quadrupole lens. Moreover, at the time of deflection, the lens intensity of the main lens dynamically weakens in accordance with the increase in the degree of deflection of the electron beam. Accordingly, it is possible to compensate an over-focus occurring when the distance, over which the electron beams travel from the main lens to the phosphor screen, is increased due to the deflection.

Besides, the additional electrode is disposed at the geometrical center between the focus electrode and anode electrode. The center of the side beam passage hole formed in the additional electrode is displaced from the center of the side beam passage hole formed in each of the focus electrode and anode electrode.

Furthermore, in accordance with the variation in the voltage applied to the second segment G32, the following value S varies:

S=[(applied voltage to the additional electrode)−(applied voltage to the focus electrode)]/[(applied voltage to the anode electrode)−(applied voltage to the focus electrode)].

Thus, the aperture lens, which is non-rotation-symmetric with respect to the straight line connecting the centers of the side beam passage holes in the focus electrode and anode electrode, is formed in the main lens. Accordingly, at the time of deflection, the loci of the side beams are varied by the aperture lens when they pass through the main lens. Thus, even where the horizontal deflection field and vertical deflection field are made substantially uniform, a convergence error can be compensated.

Therefore, the present invention can provide a color cathode-ray tube capable of displaying a high-quality image, while reducing an oval deformation of a beam spot on a peripheral area of a screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube apparatus comprising:

an electron gun structure having an electron beam generating unit for generating three electron beams arranged in line, the three electron beams comprising a center beam and a pair of side beams, and a main lens for accelerating the three electron beams generated by the electron beam generating unit toward a phosphor screen and ultimately focusing the three electron beams on the phosphor screen; and a deflection yoke for generating deflection fields for deflecting the three electron beams generated from the electron gun structure, wherein said main lens is formed by a focus electrode and an anode electrode both arranged in a direction of traveling of electron beams, at least one additional electrode disposed between the focus electrode and the anode electrode, and voltage application means for applying a voltage to each of said electrodes such that a voltage higher than a voltage applied to the focus electrode and lower than a voltage applied to the anode electrode is applied to the additional electrode, and in synchronism with deflection of the three electron beams by the deflection yoke, a value S, defined below, varies, S=[(applied voltage to the additional electrode)−(applied voltage to the focus electrode)]/[(applied voltage to the anode electrode)−(applied voltage to the focus electrode)], and wherein an angle of emission of each of the side beams emanating from the main lens varies in synchronism with a variation of the value S.

2. A color cathode-ray tube apparatus according to claim 1, wherein said additional electrode has a center beam passage hole for passage of the center beam and a pair of side beam passage holes for passage of the paired side beams, and where a distance between the center beam and the side beam, which are about to enter the additional electrode, is less than a distance between a center of the center beam passage hole and a center of the side beam passage hole, the value S decreases in accordance with an increase in a degree of deflection of the electron beams.

3. A color cathode-ray tube apparatus according to claim 1, wherein said additional electrode has a center beam passage hole for passage of the center beam and a pair of side beam passage holes for passage of the paired side beams, and where a distance between the center beam and the side beam, which are about to enter the additional electrode, is greater than a distance between a center of the center beam passage hole and a center of the side beam passage hole, the value S increases in accordance with an increase in a degree of deflection of the electron beams.

4. A color cathode-ray tube apparatus according to claim 1, wherein a difference between an angle of emission of the center beam emitted from the main lens and an angle of emission of the side beam emitted from the main lens decreases in accordance with an increase in a degree of deflection of the electron beams.

5. A color cathode-ray tube apparatus according to claim 1, wherein the deflection fields generated by the deflection yoke are substantially uniform.

6. A color cathode-ray tube apparatus according to claim 1, wherein said additional electrode is disposed at a geometrical center of the main lens, and said voltage application means applies, at a time of non-deflection, a potential, which is equal to a potential at an equipotential surface created at the geometrical center of the main lens, to the additional electrode, and applies, at a time of deflection, a potential, which is different from the potential at the equipotential surface created at the geometrical center of the main lens, to the additional electrode.

* * * * *